United States Patent [19]

Pierce

[11] 4,049,210

[45] Sept. 20, 1977

[54] STRAND WINDING APPARATUS

[75] Inventor: John H. Pierce, Reidsville, N.C.

[73] Assignee: The John Pierce Co., Inc., Reidsville, N.C.

[21] Appl. No.: 600,327

[22] Filed: July 30, 1975

[51] Int. Cl.[2] ..... B65H 54/02; B65H 54/44

[52] U.S. Cl. ..... 242/18 R; 242/18 B; 242/46.2; 242/46.4; 242/46.6

[58] Field of Search ..... 242/18 R, 18 DD, 46.2, 242/46.3, 46.4, 46.6, 18 B, 129.7, 72, 68.2, 68.3

[56] References Cited

U.S. PATENT DOCUMENTS

| | | | |
|---|---|---|---|
| 2,401,725 | 6/1946 | Elvin | 242/18 R |
| 2,572,904 | 10/1951 | Bauer | 242/18 B |
| 3,146,964 | 9/1964 | Schultz et al. | 242/72 |
| 3,166,263 | 1/1965 | Smith, Jr. et al. | 242/46.4 |

FOREIGN PATENT DOCUMENTS

| | | | |
|---|---|---|---|
| 308,537 | 10/1955 | Switzerland | 242/46.2 |
| 421,846 | 1/1935 | United Kingdom | 242/46.4 |

*Primary Examiner*—Stanley N. Gilreath

*Attorney, Agent, or Firm*—Joseph H. Heard

[57] ABSTRACT

The apparatus is particularly adapted for the formation of quite large and heavy strand packages. Its spindle assembly is so constructed as to permit rapid but exceedingly secure mounting thereon of the bobbins upon which such packages are wound, and as to satisfactorily withstand the severe stresses imposed upon its components by the weight of such packages. In a preferred embodiment of the apparatus, wherein the spindle assembly is mounted for pivotal translatory movement toward and away from a pressure roll engageable with the periphery of a strand package upon the spindle assembly, improved fluid-pressure means controls and at desired times produces the movement of the spindle assembly relative to the pressure roll. Such fluid-pressure means utilizes advantageous aspects of both hydraulic and pneumatic systems and, among other benefits, cushions return movement of the spindle assembly back toward the pressure roll following such temporary displacement therefrom as might be occasioned by a bulge or protuberance upon the periphery of the strand package.

12 Claims, 4 Drawing Figures

STRAND WINDING APPARATUS

BACKGROUND OF THE INVENTION

This invention relates to apparatus for winding strand material, including particularly yarns, filaments, cords, twine and/or other strands formed wholly or in part of natural or synthetic textile material, upon a cop, tube or other support member, hereinafter generically refered to as a "bobbin", to form a strand package. The invention more particularly relates to winding apparatuses, of which various of the so-called "precision winders" are well-known examples, having a spindle assembly which releasably mounts the bobbin for winding rotation about an axis extending generally horizontally in substantially parallel relationship to a pressure roll, forming part of guide means for directing the strand onto the bobbin, and wherein the spindle assembly is supported for translatory movement relative to the pressure roll in a direction effective to vary the distance between their respective axes.

Illustrative prior patents of possible relevance to the present invention are U.S. Pat. Nos. 3,825,195, 3,778,003, 3,733,034, 3,276,718, 2,572,904, 2,474,672, 2,250,560, 2,209,428, 2,046,550; British Pat. No. 291,046; and German Pat. No. 848,475.

In a winding apparatus of the type in question, precise positional relationships should be consistently maintained between various of its components, such as the spindle assembly and pressure roll components, and also between such components and the bobbin carried by the spindle assembly. The requisite precise positional relationships are not maintained if, during operation of the apparatus, there occurs significant deflection of one or more of the apparatus components, or excessive vibratory or similar erratic motion thereof, or if slippage occurs between the bobbin and the spindle assembly upon which it is carried. In any of the foregoing cases the winding of an inferior strand package may ensure and, in at least some instances, premature structional failure of one or more of the components of the apparatus will occur.

The possibility of encountering problems of the above-described type increases in direct relationship to the size and weight of the strand package being formed. In the formation of exceptionally large and heavy strand packages, there is significantly greater risk of bobbin-slippage, in an axial direction as well as about the circumference of the spindle assembly, and of deflection and/or premature failure of one or more components of the spindle assembly under the impetus of the greater load imposed upon such assembly by the heavy strand package. The heavier package weight also markedly increases the magnitude of the shock or impact forces which would be imposed upon the pressure roll and/or spindle assembly components of the apparatus if, following such temporary displacement therebetween as might be caused by the presence of a protuberance upon the strand package being formed, return movement of the spindle assembly back toward the pressure roll occurred too rapidly. In addition to the "bounce" or vibratory conditions which likely would be created by excessively rapid return movement of the spindle assembly toward the pressure roll, the high-magnitude shock forces imposed at the conclusion of such movement upon the spindle assembly and pressure roll components might well structurally damage either or both of them.

SUMMARY OF THE INVENTION

The present invention provides an improved strand winding apparatus which is free from the above-discussed problems and deficiencies, even when used to form strand packages of a quite large size and weight. More specifically, strand-packages weighting in the range of 150 to 200 pounds may be formed by the present strand winding apparatus without fear of overstressing, bending or otherwise adversely affecting any of its structural components, or the desired precise positional relationships between them, and without experiencing slippage of the bobbin of the package relative to the spindle assembly upon which such bobbin is releasably secured.

In the illustrative embodiment thereof described in detail hereinafter, the present invention is incorporated in a strand winding apparatus of the type wherein winding rotation is imparted to the bobbin through the spindle assembly upon which such bobbin is mounted, and the requisite translatory movement between the axes of the bobbin and the pressure roll engaging its periphery is realized by mounting of the spindle assembly adjacent one end of a support arm pivotally connected adjacent its other end to the main frame of the apparatus. The spindle assembly includes inner and outer concentric members each extending substantially the full length of the spindle assembly. The inner member is of a massive and preferably solid construction, and at one end is fixedly secured to or formed integrally with the arm supporting the spindle assembly for translatory movement. Except for its movement in unison with the spindle-assembly support arm, the aforesaid inner concentric member of the spindle assembly is immobile, even when subjected to quite large loading forces, and therefore imparts desired rigidity to the spindle assembly throughout substantially its entire length. The outer concentric member of the spindle assembly is supported for rotation upon the inner member by at least two bearing elements disposed between, and adjacent the respective opposite ends of, such members. Such arrangement more uniformly distributes the forces imposed upon the outer concentric member, including the loading forces imposed upon it by the weight of the strand package which it supports and rotates, and thus lessens if not altogether obviates the possibility of its deflection or structural failure.

The outer concentric member of the spindle assembly is so constructed as to readily receive thereon, from its free end, the bobbin upon which a strand package is to be formed. Once such bobbin is slid onto the outer concentric member, it can be quickly and easily secured in place by an operator's rotation, through only a short arc-distance, of an actuating knob mounted for convenient access at the free end of the spindle assembly. The aforesaid rotation of such knob simultaneously actuates first and second bobbin-gripping means which respectively secure the bobbin to the outer concentric member of the spindle assembly for rotative movement in unison therewith, and which prevent all possibility of axial displacement of the bobbin upon the spindle assembly during operation of the apparatus.

Rotative movement is imparted to the bobbin mounted upon the outer concentric member of the spindle assembly through such outer member and from a positive flexible drive system which is disposed adjacent the spindle assembly and the arm supporting the same for translatory movement, but which is entirely separate from the structural mounting elements of the assembly and arm. That is, the mountings of the spindle assembly and of the support arm are independent from and in no way dependent upon the limited strength of any drive shaft or other drive component of the apparatus.

Inexpensive but highly effective fluid-pressure means, which employs both a purely pneumatic circuit and a combined pneumatic and hydraulic-fluid circuit, is operatively connected to the spindle-assembly supoort arm for the purpose of moving the spindle assembly to and from a position at which bobbins may be readily doffed therefrom and donned thereon, and for the purpose of controlling movement of the spindle assembly relative to the pressure roll during strand-winding operation of the apparatus. The purely pneumatic circuit of the fluid-pressure means biases the spindle assembly toward the pressure roll, but permits relatively rapid displacement of the assembly away from the roll in response to engagement between the roll and a protuberance or the like upon the periphery of the strand package carried by the spindle assembly. The combined pneumatic and hydraulic circuit of the fluid-pressure means so retards and "cushions" the return movement of the spindle assembly back toward the pressure roll, following its temporary displacement therefrom, as to prevent structural damage to or "bounce" of the components.

DESCRIPTION OF THE DRAWINGS

Other features and advantages of the invention will be apparent from the following description of an illustrative preferred embodiment thereof, which should be read in conjunction with the accompanying drawngs, in which.

DESCRIPTION OF THE PREFERRED EMBODIMENT

Figure 1:
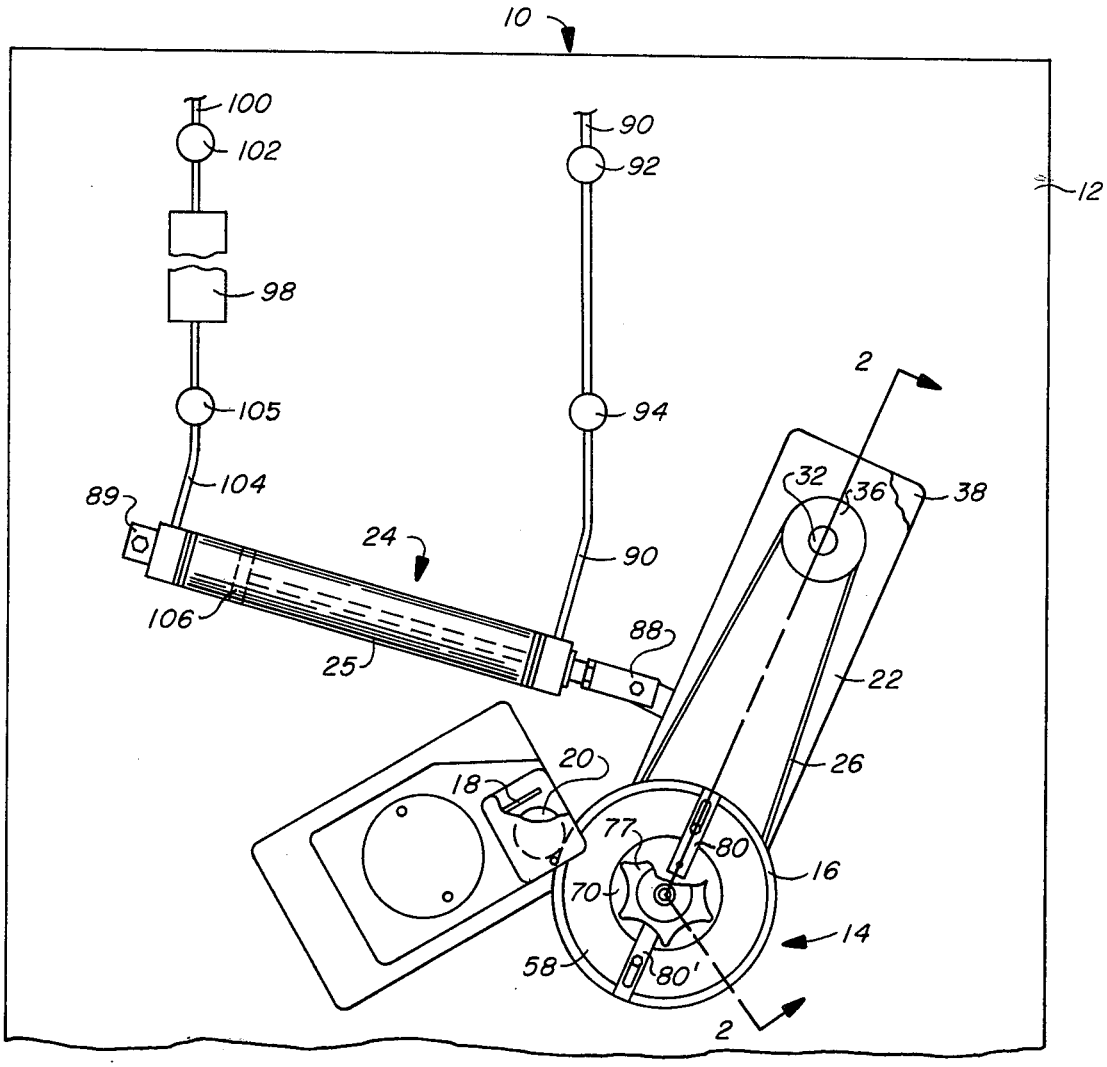
FIG. 1 is a partially schematic front elevational view of a strand winding appartus, with some components partially broken away, embodying the invention.

In FIG. 1 of the drawings there are shown portions of a strand winding apparatus 10 having a main frame which includes an upstanding frame plate 12; a spindle assembly 14 for releasably mounting tubular bobbin element 16, one at a time as shown in FIG. 1, for strand-winding rotation about its generally horizontally extending axis; strand guiding means for directing the strand (not shown) to be wound toward and onto bobbin 16, such strand guiding means including a conventional traversing mechanism 18 and a freely-rotatable pressure roll 20 which extends parallel to spindle assembly 14 and is adapted to engage the periphery of the strand package (not shown) formed during operation of apparatus 10 upon the bobbin 16 carried by assembly 14; mounting means including a pivotable support art 22 mounting spindle assembly 14 for movement toward and away from pressure roll 20 in a direction varying the direction between their central axes; fluid-pressure means, including a double-acting piston and cylinder assembly 24, for controlling and at desired times producing the aforesaid movement of spindle assembly 14 relative to pressure roll 20; and drive means, including a timing drive belt 26 operatively associated with spindle assembly 14, for during operation of apparatus 10 driving the various driven components thereof. As will be apparent to those skilled in the art, apparatus 10 does include some and could include other components of a conventional nature, such as a suitable strand-tensioning device. Such additional conventional components are not illustrated in the drawings, however, since illustration thereof is not necessary to understanding the present invention.

Figures 2, 4:
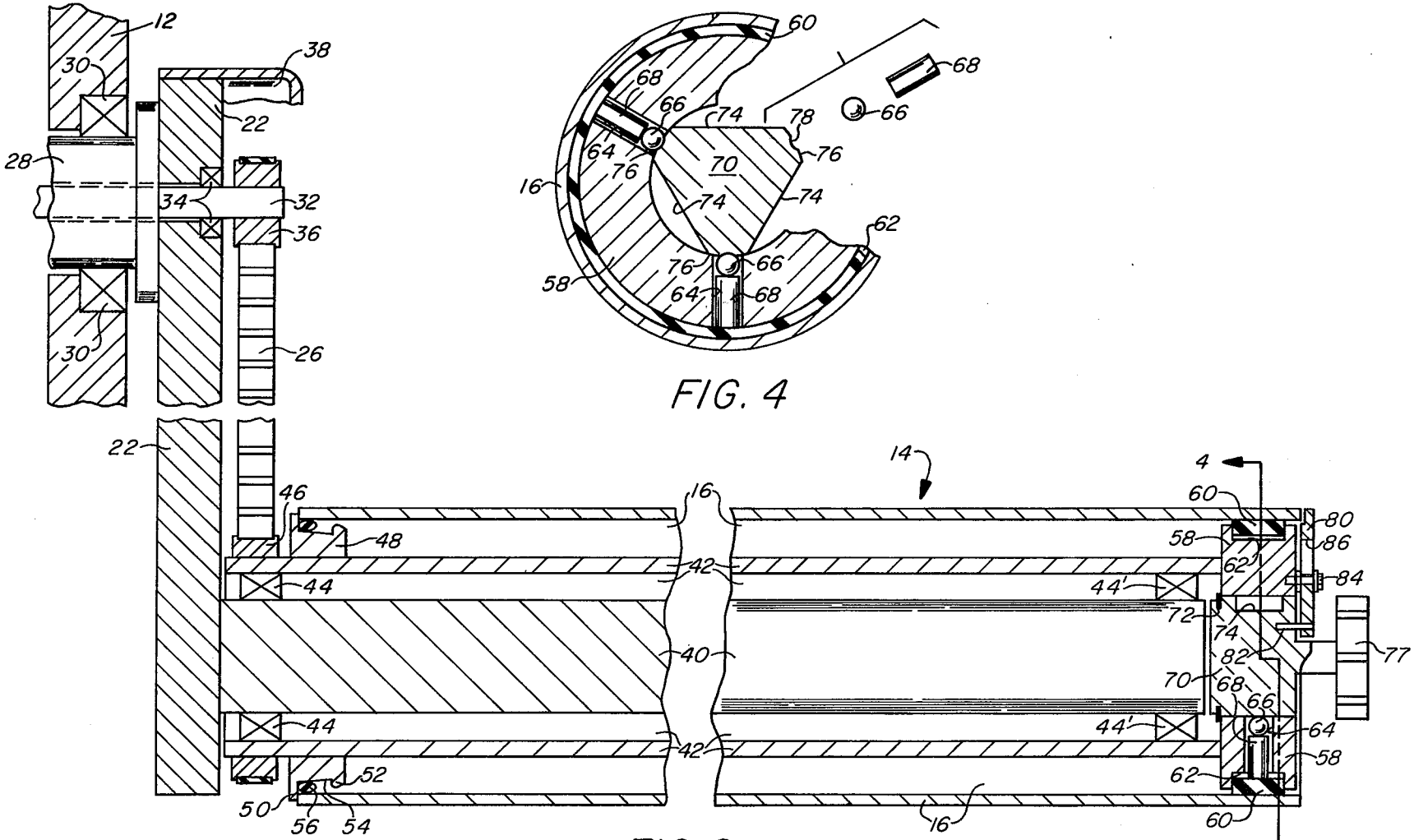
FIG. 2 is an enlarged sectional view, taken approximately along the line 2—2 of FIG. 1 and with some components broken away intermediate their length, through the spindle assemby and adjacent mounting and frame components of the winding apparatus.
FIG. 4 is an enlarged and partially-fragmentary vertical section, taken approximately along the line 4—4 of FIG. 2, through the outer end portion of the spindle assembly of the apparatus.

Referring now also to FIG. 2, as well as still to FIG. 1, support arm 22 is pivotally mounted adjacent its upper end by means of a large cylindrical journal 28 which is rigidly secured thereto or formed integrally therewith, and which projects horizontally inwardly through frame plate 12 of apparatus 10 and supporting bearings 30, one of which is shown in FIG. 2, carried by the frame of the apparatus. A shaft 32 extends coaxially and freely through journal 28 and an aligned bore provided within support arm 22, and is mounted for rotative movement relative to such components by bearings 34, one of which is shown in FIG. 2. At its inner end shaft 32 is suitably connected to the main drive components (not shown) of apparatus 10. Keyed or otherwise suitably affixed to the outer end of shaft 32 is a pulley element 36 about which is entrained the drive belt 26 operatively associated, in a manner described more fully hereinafter, with spindle assembly 14. A removable shield or guard 38, only a fragmentary portion of which is shown in the drawings, is detachably affixed to arm 22 so as to enclose pulley 36 and belt 26.

Figure 3:
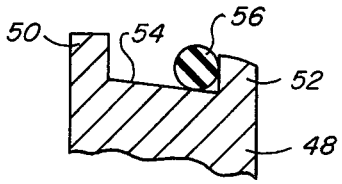
FIG. 3 is an enlarged fragmentary sectional view of spindle-assembly components also shown, in a different relationship relative to each other, in FIG. 2.

As is shown in the lower portion of FIG. 2, spindle assembly 14 of apparatus 10 includes inner and outer concentric members 40, 42, respectively, which each extend substantially the full length of assembly 14. Inner member 40 is formed integrally with, or is otherwise fixedly secured to, the lower end portion of support arm 22 and projects horizontally outwardly (to the right, as viewed in FIG. 2) therefrom. Member 40 is of relatively massive, rigid construction, illustratively being formed in major part of a solid length of steel round-stock having a diameter of approximately two inches, and is therefore capable of steadfastly withstanding, without significant deflection or the like, the loading forces imposed thereon by the weight of even the quite heavy strand packages (not shown) which apparatus 10 is capable of forming. Outer concentric member 42 is also a substantially rigid metallic construction, although of generally tubular shape. Member 42 is mounted upon inner member 40, for rotation relative to it about the common central axis of both members, by suitable bearing means disposed between such members. The aforesaid bearing means includes at least the two bearings 44,44' disposed adjacent the respective opposite end portions of members 40,42 and might, in the case of an exceptionally long spindle assembly 14, include additional similar bearings disposed intermediate the length of members 40,42. Due to the underlying support thus provided member 42 at at least both of its end portions by bearings 44, 44' and inner member 40, it will be appreciated withstanding loads and other forces of a magnitude which would cause its deflection, or possibly even its structural failure, if such member were supported at only one of its ends. A pulley 46 is keyed or otherwise fixedly secured about that end of outer spindle member 42 adjacent support arm 22, and drive belt 26 is entrained thereabout so as to impart relative movement to member 42 during operation of apparatus 10. Adjacent the same one of its ends, an outwardly-projecting collar-like member 48 (see also FIG. 3) encircles member 42 and is welded or otherwise rigidly secured thereto. Formed integrally with and about the circumferences of collar-like member 48 are two spaced flanges 50,52, the former of which has a greater height than the latter. A groove 54 extends between flanges 50,52, and is so tapered as to possess a greater depth adjacent flange 52 than adjacent flange 50. Groove 54 receives and is encircled by a resilient O-ring 56 formed of rubber or similar material. When a bobbin 16 is not mounted upon spindle assembly 14, ring 56 then is disposed within that portion of groove 54 adjacent flange 52 and, in its then uncompressed condition, projects in a radial direction slightly beyond the top surface of such flange. This is shown in FIG. 3 of the drawings. The inner diameter of the bobbins 16 adapted to be used in association with apparatus 10 is slightly greater than the outer diameter of flange 52 but is less than the outer diameter of flange 50. As a bobbin 16 is donned upon spindle assembly 14, it therefore passes freely over flange 52 and into engagement with ring 56. Following such engagement and until the bobbin-donning operation is completed by abutment of the end of bobbin 16 with flange 50, ring 56 is moved by bobbin 16 toward the shallower portion of groove 54 adjacent flange 50, and thus is progressively compressed between the confronting surfaces of the bobbin and groove. When bobbin 16 is fully donned upon assembly 14, ring 56 therefore occupies the position and is in the substantially-compressed condition shown in FIG. 2, wherein it securely seats and supports the inner (left-most, as viewed in FIG. 2) end of bobbin 16.

A second collar-like member 58 is ridigly secured, as by means of suitable pins, bolts or the like (not shown), to the opposite (right-most, as viewed in FIG. 2) end of outer spindle member 42. The outer diameter of collar member 58 is sufficiently less than the inner diameter of bobbins 16 so that a bobbin being donned upon spindle assembly 14 may pass freely and readily over collar 58. Once a bobbin 16 occupies a fully-donned position shown in FIG. 2, it is releasably secured in place, for rotation in unison with spindle member 42 during operation of apparatus 10, by improved bobbin-gripping means associated with collar member 58.

The aforesaid bobbin-gripping means includes a resilient band 60, formed of rubberous material having a relatively high coefficient of friction, encircling a groove 62 extending about the outer circumferential surface of collar 58. When in its normal contracted condition, band 60 lies entirely within groove 62 and therefore does not engage the inner surface of a bobbin 16 being doffed from or donned upon spindle assembly 14. Three bores 64 (see also FIG. 4) extend radially through collar 58 between its inner circumferential surface and the groove 62 within its outer circumferential surface. Bores 64 are spaced equally from each other about the circumference of collar 58 and identical cam-follower assemblies, each consisting of a radially inner-most ball element 66 and a radially outermost plunger element 68, are disposed within corresponding ones of the bores 64 for movement longitudinally thereof. A rotatable cam member 70 concentrically mounted within the central opening of collar 58, as by means of a retainer ring 72, has three sets of alternating low and high cam surfaces 74,76, respectively, formed upon its periphery for selective underlying engagement with ball elements 66. Actuating means in the form of an operating knob 77, disposed for convenient operator-access at the free end of spindle assembly 14, is fixedly secured to or formed integrally with cam member 70. By rotation of knob 77 through only a small arc distance, either high surfaces 76 or low surfaces 74 upon the periphery of cam member 70 may be quickly and alternatively brought into underlying engagement with associated ones of the balls 66 disposed within collar bores 64. Movement of high surfaces 76 beneath balls 66 causes, as shown in FIGS. 2 and 4, plungers 68 to deflect resilient band 60 outwardly from the groove 62 within the periphery of collar 58 and, assuming a bobbin 16 is then carried by spindle assembly 14, into frictionally-gripping engagement with the inner surface of such bobbin. Suitable detent or stop means, illustratively in the form of shallow concave recesses 78 formed upon high surfaces 76 and seating balls 66 when underlying the same, releasably retains the aforesaid relationship between the indicated components of spindle assembly 14 during stand-winding operation of apparatus 10. At such time can member 70 rotates in unison with collar 58. Upon completion of a strand-winding operation, the aforesaid gripping engagement between band 60 and bobbin 16 may be quickly and easily terminated simply by rotating knob 77 relative to collar 58 the small amount necessary to displace high surfaces 76 of cam member 70 from beneath balls 66. Once surfaces 76 are displaced from beneath ball 66, band 60 returns to its normal contracted position, wherein it is disposed entirely within groove 62 and beneath the outermost periphery of collar 58, thereby permitting convenient removal of the full bobbin 16 from spindle assembly 14 and the subsequent donning of another empty bobbin upon the spindle assembly. Doffing of a bobbin 16 from assembly 14 automatically causes O-ring 56 to return to its noncompressed condition and approximate position shown in FIG. 3.

It should be noted that institution and termination of the aforesaid gripping engagement between band 60 and bobbin 16 can be effected by rotation of knob 76 in either direction, and through only a quite limited arc distance. Ease of operation is also facilitated, and wearing of the components is minimized, by the fact that balls 66 rotate about their centers as cam member 70 is rotated relative to collar 58.

The primary function of the gripping engagement realized between band 60 and the inner circumference of a bobbin 16 is to secure the bobbin for rotation in unison with outer spindle member 42 during operation of apparatus 10. Such engagement also contributes to some extent toward preventing undesirably longitudinal or axial displacment of a bobbin 16 in the direction of the free end of spindle assembly 14 during operation of the apparatus. It has been found, however, that the aforesaid engagement by band 60 may not by itself always be sufficient to prevent such axial bobbin displacement when the strand packages (not shown) formed by apparatus 10 are of the presently-contemplated large size and heavy weight. The present bobbin-gripping means therefore further includes latching means, actuable simultaneously with the previouslydescribed components and by the same simple rotative movement of knob 77, for positively engaging the free (right-most, as viewed in FIG. 2) end of a bobbin 16 carried by spindle assembly 14 and for thereby preventing all possibility of the bobbin's axial displacement during operation of apparatus 10. Such latching means includes at least one and preferably and illustratively (see FIG. 1) a pair of identical elongate latch elements 80,80' disposed between cam member 70 and knob 77 and extending generally radially outwardly in opposite directions from the projected axis of spindle assembly 14. As is more clearly shown in FIG. 2 in the case of the one latch element 80, the same is pivotally secured adjacent its radially innermost end portion to the exterior vertical face of cam member 70 by means of a pivot pin 82, and is loosely connected intermediate its length to the exterior vertical face of collar 58 by means of a stud or bolt 84, with which suitable washers are associated, projecting through an elongate slot 86 provided within the aforesaid intermediate portion of latch 80. When knob 77 occupies a rotative position relative to collar 58 such as is shown in FIGS. 1 and 2, at which time the inner circumference of bobbin 16 is gripped by band 60, latches 80,80' extend generally radially with respect to the axis of assembly 14 and the outermost ends thereof overlap the outer end of bobbin 16 and thus prevent any possibility of significant axial bobbin displacement, during operation of apparatus 10, in the direction of the free end of spindle assembly 14. When knob 77 is rotated so as to release the gripping engagement of bobbin 16 by band 60, such rotation simultaneously causes latches 80,80' to pivot about pins 82 to retracted positions (not illustrated in the drawings) wherein their outer ends are disposed radially inwardly of bobbin 16, and wherein the latch elements do not impede the doffing of bobbin 16 and the subsequent donning of another empty bobbin upon spindle assembly 14. It will therefore be appreciated that actuation and deactuation of latches 80,80' occurs simultaneously with the bringing of band 60 into and out of gripping engagement with bobbin 16, and in automatic response to the simple limited rotation of knob 77 which effects the latter result.

Referring now once again primarily to FIG. 1, piston and cylinder assembly 24 is pivotally connected adjacent its opposite ends by suitable pivot means 88,89, respectively, to frame plate 12 and to the support arm 22 mounting spindle assembly 14 for movement toward and away from pressure roll 20 of apparatus 10. As indicated in FIG. 1, assembly 24 extends approximately normal to support arm 22 at the outset of a winding operation. At that end thereof adjacent spindle assembly 14 (the right-most end, as viewed in FIG. 1), pressurized air from a suitable source (not shown) is introducable into cylinder component 25 of assembly 24 through a pneumatic circuit which includes a flexible conduit 90, a pressure regulator 92, and a manually-operable valve 94. The end of cylinder 25 which is distal from spindle assembly 14 (the left-most end, as viewed in FIG. 1) communicates with a combination pneumatic and hydraulic circuit. Such circuit includes a closed tank or reservoir 98 containing oil or other suitable hydraulic fluid; a conduit 100 interconnecting, through a pressure regulator 102, the upper part of reservoir 98 with a source (not shown) of pressurized air; and a flexible conduit 104 interconnecting the lower portion of reservoir 98 and the left end of cylinder 25 of assembly 24. Although not necessary in all instances, the circuit may further include a one-way flow-restricting device 105 which, while permitting the flow of hydraulic fluid in both directions between reservoir 98 and cylinder 25, restricts to an adjustably-variable degree the rate of such flow when the direction thereof is from cylinder 25 to reservoir 98. The volume of reservoir 98 is such that, at all times during operation of apparatus 10, the portion of cylinder 25 to the left of the piston component 106 of assembly 24 is filled with hydraulic fluid, which fluid is under a pre-selected and substantially constant pressure obtained by suitable adjustment of the regulator 102 through which pressurized air is introduced into the upper portion of reservoir 98. The air introduced during strand-winding operation of apparatus 10 into the opposite or right end of cylinder 25 of assembly 24 is maintained at a substantially constant higher pressure, by appropriate initial setting of regulator 92, so that assembly 24 biases support arm 22 in a direction tending to maintain engagement between the peripheries of pressure roll 20 and the strand package (not shown) being formed upon the bobbin 16 carried by spindle assembly 14. Such arrangement permits gradual movement of spindle assembly 14 away from pressure roll 20 as the diameter of the strand package gradually increases during operation of apparatus 10, and also permits relatively rapid displacement of assembly 14 away from roll 20 under the impetus of engagement between such roll and a protuberance or "bulge" such as at times might be present upon the periphery of the strand package. Following such temporary displacement of assembly 14 away from roll 20, the higher pressure-force maintained upon the right side of piston 106 of assembly 24 tends to cause rapid return movement of spindle assembly 14 back toward roll 20. Except possibly in the case of apparatuses which wind relatively small packages at exceptionally high speeds, such rapid return movement and the ensuing abrupt re-establishment of engagement between the pressure roll and the periphery of the strand package being formed are not desirable. When a large and heavy strand package is being wound at normal winding speeds, too rapid return movement of the spindle assembly can produce such undesirable consequences as "bounce", vibration and/or deflection or structural failure of the pressure roll or other components of the winding apparatus. In the present apparatus 10, the possibility of the aforesaid undesirable results occurring is minimized, if not altogether obviated. While producing return movement of spindle assembly 14 back toward pressure roll 20, assembly 24 "cushions" and damps such return movement, which can occur only at the slower rate permitted by expulsion of hydraulic fluid from the left end of cylinder 25 through conduit 104. Such expulsion of fluid from cylinder 25 of course does not occur instantaneously since resisted by the pressures of the hydraulic fluid and the pressurized air within reservoir 98 and, if such component is used in apparatus 10, by the flow-restricting device 105 within conduit 104. With the present apparatus 10, there is therefore little or no possibility of detrimental consequences ensuing from return movement of assembly 14 back toward roll 20 following its temporary displacement by the presence of a bulge or the like upon the circumference of the strand package (not shown) being formed.

Upon completion of a strand winding operation by apparatus 10, valve 94 may be moved by operator to another operating position thereof in which the valve interrupts the supplying of pressurized air to the right end of cylinder 25 and vents such end of the cylinder to the atmosphere. Due to the continued force exerted upon the left side of its piston 106, this causes maximum extension of assembly 14 and thus causes spindle assembly 14 to be moved to and maintained in a position distal from pressure roll 20, permitting convenient doffing of the fully-wound strand package (not shown) from the spindle assembly and the subsequent donning of another empty bobbin 16 thereon. Following the donning operation, pressurized air is again introduced into the right end of cylinder 25, by an operator's restoration of valve 94 to its normal operating position, whereupon assembly 24 again moves spindle assembly 14 to its FIG. 1 position of readiness for the commencement of a strand-winding operation.

By its utilization in part of features of both types of circuits, the above-described fluid-pressure system realizes the advantages but avoids the disadvantages of those which are either purely pneumatic or purely hydraulic. Use of a purely pneumatic circuit at that end of assembly 24 adjacent spindle assembly 14 permits the desirably relatively rapid displacement of spindle assembly 14 away from pressure roll 20, in response to engagement between the pressure roll and a bump or protuberance upon the circumference of the strand package being formed, and also minimizes the possibility of contamination of the strand material (not shown) by leakage of hydraulic fluid. Use of the combined hydraulic and pneumatic circuit at the opposite end of assembly 24 affords "cushioning" of the return movement of spindle assembly 14 back toward pressure roll 20, following its aforesaid temporary displacement, while achieving such desirable result without the use of hydraulic pumps or similar expensive components which would add significantly to the cost of apparatus 10.

Although a timing-belt drive has been shown in association in spindle assembly 14, a chain-and-sprocket or other type of flexible but positive drive could of course be employed.

While a preferred embodiment of the invention has been specifically shown and described, it is to be understood that this was for purposes of illustration only, and not for purposes of limitation, the scope of the invention being in accordance with the following claims.

That which is claimed is:

1. In an apparatus for winding a textile strand onto a bobbin to form a strand package, said apparatus including a frame, a generally horizontally-extending spindle assembly adapted to mount said bobbin for rotation about a central axis during operation of said apparatus, strand-guiding means for guiding the strand onto the bobbin during operation of said apparatus, said strand-guiding means including a pressure roll extending generally parallel to said spindle assembly and engagable with the periphery of the strand package formed upon said bobbin carried by said spindle assembly during operation of said apparatus, and movable support means carried by said frame and mounting said spindle assembly for translatory movement toward and away from said pressure roll, the improvememt comprising:

said spindle assembly including inner and outer elongate spindle members extending in substantially concentric relationship to each other and to said central axis of said spindle assembly throughout substantially the entire length of said assembly, said inner member being of massive rigid construction and being fixedly and immovably secured at one end thereof to said support means for movement in unison therewith, first and second bearing means disposed between said inner and outer spindle members adjacent opposite ends of said members, said bearing means mounting said outer member for translatory movement in unison with said inner member relative to said pressure roll and mounting said outer member for rotative movement relative to said inner member about said central axis of said spindle assembly;

bobbin-gripping means carried by said spindle assembly for when actuated releasably securing said bobbin upon said outer member of said assembly during operation of said apparatus;

drive means, operatively connected to said spindle assembly separately from and independently of said support means, for during operation of said apparatus imparting rotative movement to said outer spindle member and to said bobbin secured thereon;

said support means including a cylindrical journal member, and bearing means innerconnecting said journal member and said frame of said apparatus for direct support of said journal member by said frame; and said drive means including a rotatable drive shaft extending freely and generally co-axially through said journal member in radially-spaced relationship thereto.

2. Apparatus as in claim 1, and further including rotatable knob means carried by said spindle assembly at the free end thereof distal from said support means and rotatable in either rotative direction about said central axis of said assembly relative to said outer member thereof for actuating said bobbin-gripping means; and wherein said drive means further includes a pulley element carried upon the exterior of said outer member of said spindle assembly closely adjacent said one end thereof.

3. Apparatus as in claim 2, wherein said bobbin-gripping means includes first means for when actuated frictionally gripping the interior surface of said bobbin and thereby securing said bobbin for rotation in unison with said outer member of said spindle assembly, and second means engageable when actuated with the terminal end of said bobbin adjacent the free end of said spindle assembly for restricting longitudinal movement of said bobbin in the direction of said free end of said spindle assembly; said first and said second bobbin-gripping means being actuated substantially simultaneously by rotation of said knob member.

4. In an apparatus for winding a textile strand onto a bobbin to form a strand package, said apparatus including a frame, a generally horizontally-extending spindle assembly adapted to mount said bobbin for rotation about a central axis during operation of said apparatus, strand-guiding means for guiding the strand onto the bobbin during operation of said apparatus, said strand-guiding means including a pressure roll extending generally parallel to said spindle assembly and engageable with the periphery of the strand package formed upon said bobbin carried by said spindle assembly during operation of said apparatus, and movable support means carried by said frame and mounting said spindle assembly for translatory movement toward and away from said pressure roll, the improvement comprising:

said spindle assembly including inner and outer elongate spindle members extending in substantially concentric relationship to each other and to said central axis of said spindle assembly throughout substantially the entire length of said assembly, said inner member being of massive rigid construction and being fixedly secured at one end thereof to said support means for movement in unison therewith, first and second bearing means disposed between said inner and outer spindle members adjacent opposite ends of said members, said bearing means mounting said outer member for translatory movement in unison with said inner member relative to said pressure roll and mounting said outer member for rotative movement relative to said inner member about said central axis of said spindle assembly;

bobbin-gripping means carried by said spindle assembly for when actuated releasably securing said bobbin upon said outer member of said assembly during operation of said apparatus; said bobbin-gripping means including first means for when actuated frictionally gripping the interior surface of said bobbin and thereby securing said bobbin for rotation in unison with said outer member of said spindle assembly, and second means engageable when actuated with the terminal end of said bobbin adjacent the free end of said spindle assembly for restricting longitudinal movement of said bobbin in the direction of said free end of said spindle assembly;

manually-operable actuating means disposed at said free end of said spindle assembly for simultaneously actuating said first and said second bobbin-gripping means, said actuating means including an operating knob mounted at said free end of said spindle assembly for rotative movement about said axis thereof relative to said inner member of said spindle assembly; and said second bobbin-gripping means comprising latch means operatively connected to said knob and pivotably movable by said rotative movement of said knob toward and away from said end of said bobbin.

5. Apparatus as in claim 4, wherein said latch means comprises a plurality of latch elements circumferentially spaced approximately equally from each other about said axis and extending generally radially with respect thereto.

6. Apparatus as in claim 4 wherein said outer member of said spindle assembly includes a collar-like member having an annular groove within the outer peripheral surface thereof; and wherein said first bobbin-gripping means includes a resilient annular band disposed within said groove of said collar member and normally underlying said peripheral surface thereof; and a plurality of biasing assemblies carried by said collar member radially inwardly of said band and at spaced locations about the circumference thereof for, upon actuation of said first bobbin-gripping means, biasing said band outwardly from said groove and into frictionally gripping engagement with said bobbin.

7. Apparatus as in claim 6, wherein said collar-like member has a plurality of bores extending generally radially therethrough between its inner circumferential surface and said annular groove within said outer surface thereof, each of said biasing assemblies being received within and movable axially of an associated one of said bores; and wherein said actuating means further includes a cam member connected to said operating knob and mounted for rotation centrally of and relative to said collar member, said cam member having a plurality of cam surfaces thereon disposed in proximity to said inner circumferential surface of said collar member and effecting movement of said assemblies longitudinally of said bores upon rotation of said operating knob.

8. Apparatus as in claim 7, wherein each of said biasing assemblies includes a radially-innermost ball element engageable with said cam member, and a radially-outermost plunger element disposed between said ball element and said band.

9. Apparatus as in claim 1, and further including fluid-pressure means operatively connected to said support means for controlling said translatory movement of said spindle assembly relative to said pressure roll, said fluid-pressure means including: pneumatic-circuit means for biasing said spindle assembly toward said pressure roll while permitting gradual movement of said assembly away from said roll to accommodate increases in diameter of the strand package during normal operation of said apparatus, and while permitting relatively rapid temporary displacement of said assembly away from said roll in response to engagement between said roll and a protuberance upon the circumferential surface of said strand package; and combination pneumatic and hydraulic circuit means for permitting and for retarding and cushioning return movement of said assembly back toward said roll following said temporary displacement of said assembly.

10. In an apparatus for winding a strand onto a bobbin to form a strand package, said apparatus including a spindle assembly adapted to mount said bobbin thereon for strand-winding rotation about its axis, a roll assembly extending generally parallel to said spindle assembly and adapted to engage the circumferential surface of said strand package during formation thereof upon the bobbin carried by said spindle assembly, and means mounting one of said assemblies for translatory lateral movement toward and away from the other of said assemblies, improved fluid-pressure means operatively connected to said one assembly for controlling said translatory movement thereof toward and away from said other assembly, comprising:

pneumatic circuit means for biasing said one assembly toward said other assembly while permitting gradual movement of said one assembly away from said other assembly to accommodate increases in the diameter of said package during normal operation of said apparatus and while also permitting relatively rapid temporary displacement of said one assembly away from said other assembly upon engagement between said roll assembly and a protuberance upon said circumferential surface of said package being formed; and combination pneumatic and hydraulic circuit means for permitting and for cushioning and retarding return movement of said one assembly back toward said other assembly following said temporary displacement of said one assembly away from said other assembly.

11. Apparatus as in claim 10, and including a piston-and-cylinder device operatively associated with said one assembly, said pneumatic circuit means being connected to one end portion of said device for maintaining pressurized air therewithin during normal winding operation of said apparatus, and said pneumatic and hydraulic circuit means being operatively connected to the other end portion of said cylinder for maintaining hydraulic fluid therewithin during normal winding operation of said apparatus while permitting the controlled expulsion of hydraulic fluid from said other end portion of said cylinder for the purpose of cushioning and retarding said return movement of said one assembly.

12. Apparatus as in claim 11, wherein said combination circuit means includes a closed hydraulic-fluid reservoir, conduit means for conducting hydraulic fluid from said reservoir to said one end portion of said cylinder and vice-versa, and means for maintaining hydraulic fluid within said reservoir under pneumatic pressure.

* * * * *

UNITED STATES PATENT AND TRADEMARK OFFICE

CERTIFICATE OF CORRECTION

PATENT NO. : 4,049,210

DATED : 20 September 1977

INVENTOR(S) : John H. Pierce

It is certified that error appears in the above-identified patent and that said Letters Patent are hereby corrected as shown below:

Col. 1, line 39, "ensure" should read -- ensue --; line 45, "package" should read -- packages --.
Col. 2, line 7, "weighting" should read -- weighing --.
Col. 3, line 34, "drawngs" should read -- drawings --; line 37, "appartus" should read -- apparatus --; line 58, "element" should read -- elements --; line 68, "art" should read -- arm --.
Col. 4, line 3, "direction" should read -- distance --; line 54, "also" should read -- also of --; line 68, "appreciated withstanding" should read -- appreciated that member 42 is capable of withstanding --.
Col. 5, line 6, "relative" should read -- rotative --; line 41, "ridigly" should read -- rigidly --.
Col. 6, line 58, "undesirably" should read -- undesirable --.
Col. 11, line 44, "4 wherein" should read -- 4, wherein --.

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*